United States Patent [19]

Sakamoto et al.

[11] Patent Number: 5,035,010

[45] Date of Patent: Jul. 30, 1991

[54] RECIPROCATING SHOWER DEVICE FOR HUMAN USAGE WHEN SHOWERING

[75] Inventors: Jun-ichi Sakamoto, Yawata; Tetsuya Onkura, Katano; Kouichi Yoshida, Nara, all of Japan

[73] Assignee: Matsushita Electric Works, Ltd., Osaka, Japan

[21] Appl. No.: 398,836

[22] Filed: Aug. 14, 1989

[30] Foreign Application Priority Data

| | | | |
|---|---|---|---|
| Aug. 26, 1988 | [JP] | Japan | 63-212914 |
| Nov. 15, 1988 | [JP] | Japan | 63-288152 |
| Nov. 15, 1988 | [JP] | Japan | 63-288153 |
| Jan. 26, 1989 | [JP] | Japan | 1-8112 |
| Jan. 26, 1989 | [JP] | Japan | 1-17291 |

[51] Int. Cl.[5] ..... A47K 3/20; A47K 4/00

[52] U.S. Cl. ..... 4/567; 4/605; 4/615; 4/606; 4/601; 239/752

[58] Field of Search ..... 4/567, 615, 605, 192, 4/596, 191; 239/240-242, 173-174, 752, 282; 128/38, 65, 66

[56] References Cited

U.S. PATENT DOCUMENTS

| | | | |
|---|---|---|---|
| 2,685,093 | 8/1954 | Lundquist | 4/191 |
| 3,005,995 | 10/1961 | Bickford | 4/191 |
| 3,806,963 | 4/1974 | Flynn | 4/192 |
| 4,171,094 | 10/1979 | Halfan | 239/752 |
| 4,360,159 | 11/1982 | Haynes | 4/605 X |
| 4,402,459 | 9/1983 | Barry | 239/752 |
| 4,561,136 | 12/1985 | Baer | 4/615 |
| 4,651,720 | 3/1987 | Baus | 128/38 |

*Primary Examiner*—Henry K. Artis

*Attorney, Agent, or Firm*—Burns, Doane, Swecker & Mathis

[57] ABSTRACT

A shower device includes a housing having a longitudinally elongated slit substantially in center part of the housing, substantially all constituents of the device being accommodated within the housing, so that a guide rail is disposed along the slit and a slider carrying a shower nozzle is displaced by a drive means for reciprocation along the guide rail with the shower nozzle disposed at the slit. The device is thus made excellent in the appearance and also in the safety with all water hoses disposed inside the housing.

13 Claims, 13 Drawing Sheets

RECIPROCATING SHOWER DEVICE FOR HUMAN USAGE WHEN SHOWERING

TECHNICAL BACKGROUND OF THE INVENTION

This invention relates to a shower device provided for a reciprocation of shower nozzle to have hot or cold water ejected along the height of user's body.

The shower device of the kind referred to is installed in a shower or bath room to be effectively employable for physical and mental activation with the shower in accordance with, if required, a predetermined sequence of the reciprocation of the nozzle with respect to various body parts of the user.

DISCLOSURE OF PRIOR ART

While the shower device has been generally utilized as a convenient bathing means in view of its effective contribution to water or energy saving, it has been made an attempt to increase blood flow rate by means of continuous skin stimulation and thermal excitement with ejected pressure of the shower for the activation of respective functions of circulatory system, respiratory apparatus, autonomic nerve system and so on and eventually the body and mind of the user. It has been considered that the shower is effective as a beauty treatment by means of relief from fatigue or promotion of human body metabolism, accompanying such activation of the body and mind.

In the above case, it is demanded to render the stimulation or excitement maintained to be relatively effective by varying the temperature or pressure of the ejected hot or cold water. In order to still save water or energy in this event, there has been suggested an arrangement of moving the shower nozzle vertically to apply the ejected water or hot water over the height of the body. An example of this type shower device is disclosed in U.S. Pat. No. 4,651,720 of Heinz G. Baus.

In this U.S. patent, however, an improvement in the appearance is desirable since the shower nozzle and connecting water hoses are left in directly exposed state, and it is also desired to solve such risky problems in respect of safety that the nozzle and hoses are brought into direct contact with the user's body and the hoses are caused to be entangled mutually or with the user's arms or legs. Such risky problems become more remarkable when, for example, a parent and a baby take the shower, in such that the entangling hoses or the one pulled by the baby or child may be likely to cause nozzle drive mechanism involved in a trouble so as to be disabled. In the patent, further, water is employed in both of the nozzle drive mechanism and shower mechanism so that an inherent pressure loss in the nozzle drive mechanism will cause a sufficient shower ejection pressure difficult to be attained specifically in zones where supplied water pressure is low, rendering the device to be insufficient for effective use as it stands and an additional use of booster pump or the like to be necessitated for an optimum shower ejection, and there has been involved a problem that installation costs become so high. Further, the shower ejection pressure has been well related to the speed of the vertical movement of the shower nozzle, and there has been a further problem that an elevation of the shower pressure also results in a concurrent acceleration of the vertical movement of the shower nozzle, and an optimum speed of the nozzle's vertical movement has been difficult to attain.

TECHNICAL FIELD

A primary object of the present invention is, therefore, to provide a shower device which is excellent in the appearance, improved in the safety and still low in the facility costs.

This object of the present invention is attained by a shower device in which hot or cold water is supplied to a shower nozzle which is driven to displace along the user's body by means of a drive means with the supply and discharge of water for applying a shower of water to the user's body, characterized in that a housing provided substantially in the center with a longitudinally elongated slit accommodates therein substantially all of constituents of the device, a guide rail is disposed within the housing to lie along the elongated slit, and the shower nozzle is supported by a slider means driven through a drive means for reciprocation along the guide rail.

According to the shower device of the present invention of the foregoing arrangement, the appearance is excellent as substantially all constituent members are accommodated within the housing, and safety assurance and trouble prevention can be realized by such accommodation, in particular, of elongated hoses for supplying the water so as not to be exposed to the exterior.

Other objects and advantages of the present invention shall be made clear in following description of the invention detailed with reference to preferred embodiments shown in accompanying drawings.

Figure 1:
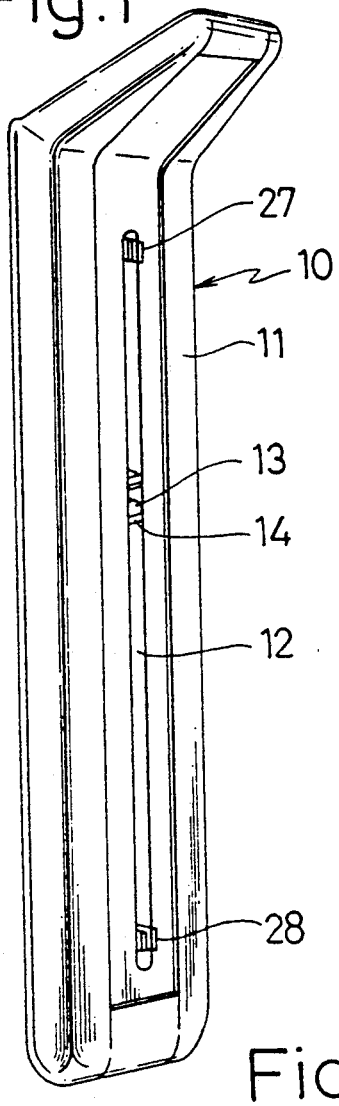
FIG. 1 is an entire perspective view of the shower device in an embodiment according to the present invention.

While the present invention shall now be explained with reference to the embodiments shown in the drawings, it should be appreciated that the present invention is not to be limited to the embodiments shown but to rather include all modifications, alterations and equivalent arrangements possible within the scope of appended claims.

DISCLOSURE OF PREFERRED EMBODIMENTS

Figure 13:
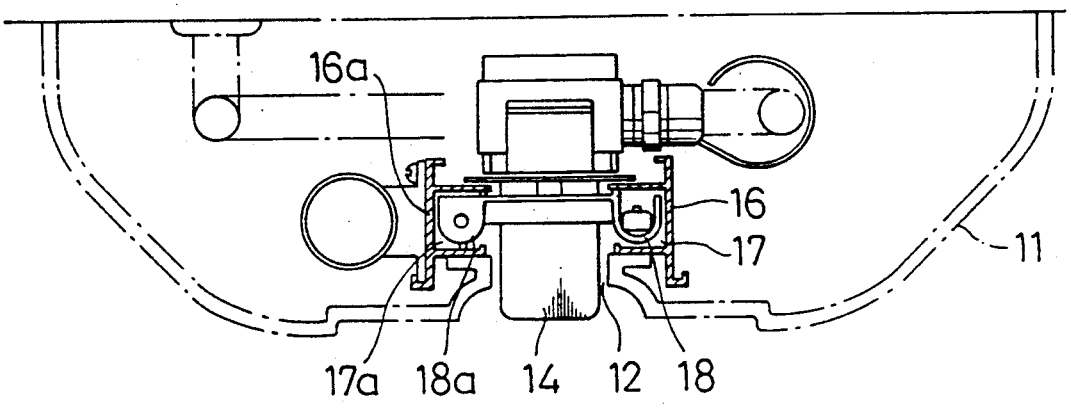
FIG. 13 is a sectional view of the device of FIG. 1 for showing relationship between the guide rail and the slider.

Referring to FIG. 1, there is shown a shower device 10 according to the present invention, which comprises a vertically elongated housing 11 having a longitudinally elongated slit 12 made substantially in central part, and substantially all constituents of the device including mainly a shower nozzle 13, slider 14 to which the nozzle 13 is secured and means 15 for driving the slider 14 for its reciprocation along the slit 12 are accommodated within the housing 11. In the interior of the housing 11, a pair of vertically elongated guide rails 16 and 16*a* is provided to oppose each other along the slit 12, and the slider 14 is mounted between these guide rails 16 and 16*a* for reciprocating motion therealong, with the shower nozzle 13 disposed to expose its ejecting end outside the housing 11 through the slit 12. In this case, the guide rails 16 and 16*a* are formed to define opposed guide grooves 17 and 17*a*, and both side sliding portions 18 and 18*a* of the slider 14 are engaged in these guide grooves 17 and 17*a* (see in particular FIG. 13).

The reciprocating drive means 15 comprises a vertically elongated hydraulic cylinder 19 having a piston 20 sealed therein, and this piston 20 can be moved for reciprocation in longitudinal direction of the cylinder 19 with water supply into or discharge from an upper space 20A or a lower space 20B with respect to the piston 20. A wire 21 is connected to the piston 20, as hung in tight state between a pair of pulleys 22 and 22*a* provided as mutually spaced by a distance slightly longer than the cylinder 19, and the slider 14 is coupled to this wire 21 on one side of the cylinder 19.

The water supply and discharge with respect to the hydraulic cylinder 19 are carried out through such change-over valve 23 as a four-way valve, and such a hydraulic source as a low pressure pump (not shown) performs the water supply or discharge alternately with respect to the upper space 20A or the lower space 20B of the piston 20 in response to change-over action of the valve 23. With this arrangement, the slider 14 is caused to slide downward by the piston 20 moved upward and to slide upward when the piston 20 is moved downward. A slide rod 24 is passed through the slider 14 for its free sliding, and flexible hoses 25 and 25*a* for supplying water are connected to the slider 14. These hoses 25 and 25*a* are connected, at their one end, to one side of the slider 14 opposite to the side on which the slider is coupled to the wire 21, that is, on the side opposite to the hydraulic cylinder 19 and, at the other end, to hot-water and cold-water supply pipe ends (not shown) installed, for example, at a wall of a shower or bath room on the side opposite to the slider 14 with respect to the hydraulic cylinder 19, while being extended to be U-shaped as a whole to enclose lower part of the cylinder 19. Disposing thus the flexible hoses 25 and 25*a* in well balanced state on both sides of the guide rails 16 and 16*a* as in the above, required space of occupation of the hoses 25 and 25*a* can be minimized, and the disposition can be contributive to the minimization in the thickness of the dimensions as well of the housing 11 and eventually the entire device 10. If required, a hose guide 26 may optimumly be extended from the slider 14 (see in particular FIGS. 4 and 8) so as to have the U-shaped flexible hoses 25 and 25*a* restrained from becoming larger in the curvature upon operation of the slider 14.

Figure 2:
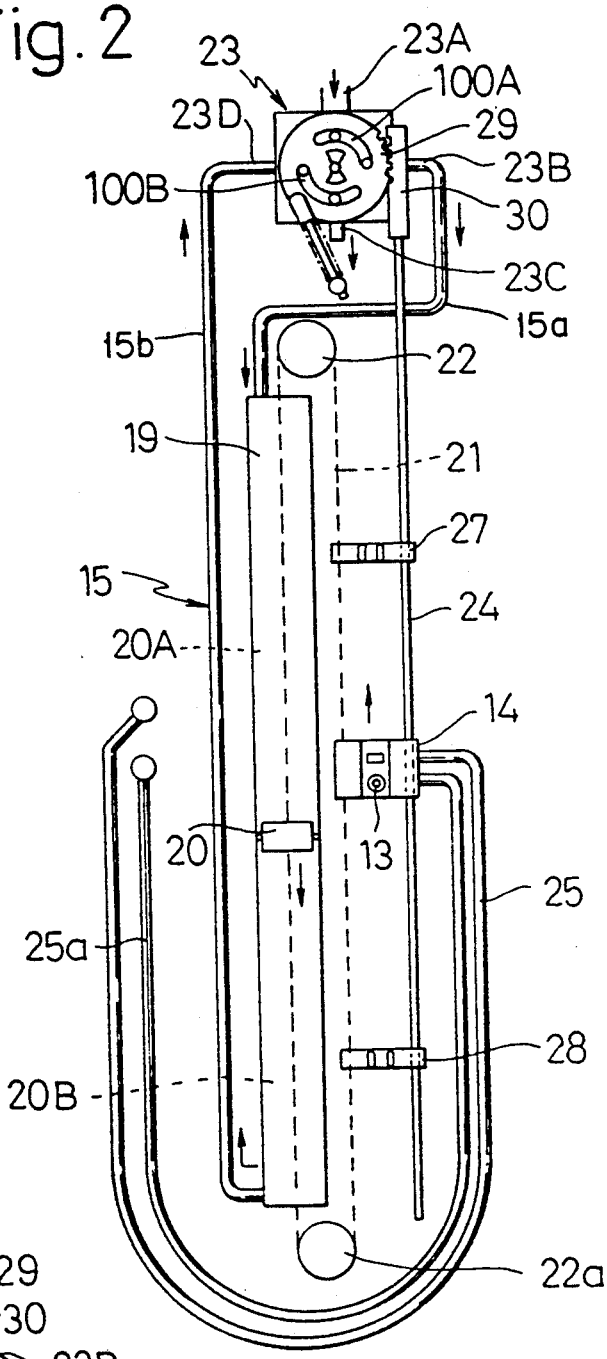
FIG. 2 is a schematic front elevation of the shower device of FIG. 1 with a housing removed for explaining its interior mechanism.
Figure 3:
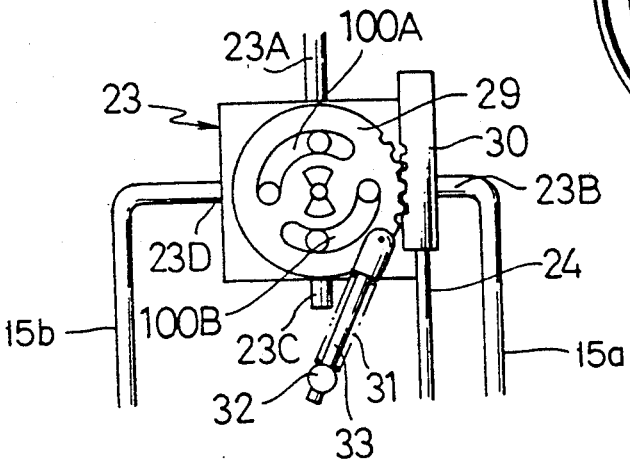
FIG. 3 is a fragmentary view as magnified for explaining a change-over valve of a slider drive system in the shower device of FIG. 1.

To the slide rod 24, there are mounted an upper height control clamp 27 and a lower height control clamp 28 for being displaceable along the rod 24 and for being fixed to any desired position thereon. To the upper end of the slide rod 24, a rack 30 in mesh with a change-over pinion 29 of the change-over valve 23 is secured so that the change-over pinion 29 will be turned normal or reverse in response to upward movement or downward movement of the rack 30. In the present instance the change-over valve 23 is provided with four ports 23A, 23B, 23C and 23D while a change-over valve body 100 coupled through a valve shaft 101 to the change-over pinion 29 is formed to include two arcuate paths 100A and 100B so that, upon the normal turn of the pinion 29, for example, the port 23A for supplying water and the port 23C for discharging water are made to communicate through the arcuate paths 100A and 100B, respectively, with each of the ports 23B and 23D, as seen in FIG. 2, and, if the port 23B communicates with the upper space 20A in the hydraulic cylinder 19 while the port 23D communicates with the lower space 20B in the cylinder 19, the supplied water from the supply port 23A flows into the upper space 20A whereas water inside the lower space 20B is caused to be discharged through the discharge port 23C. Upon the reverse turn of the change-over pinion 29, on the other hand, the supply port 23A and discharge port 23C are made to communicate respectively with each of the ports 23D and 23B, as seen in FIG. 3, and an operation reverse to the above is to be carried out. The ports 23B and 23D are connected to opposite ends of the cylinder 19 by means of conduits 15*a*, 15*b* which alternate as a water supply conduit and a water discharge conduit due to operation of the change-over valve 23. It will be appreciated that, accompanying this operation, the piston 20 displaced downward and upward in the cylinder 19 causes, through the wire 21, the slider 14 to slide upward and downward in opposite direction to the piston 20, as has been partly referred to.

Figure 14:
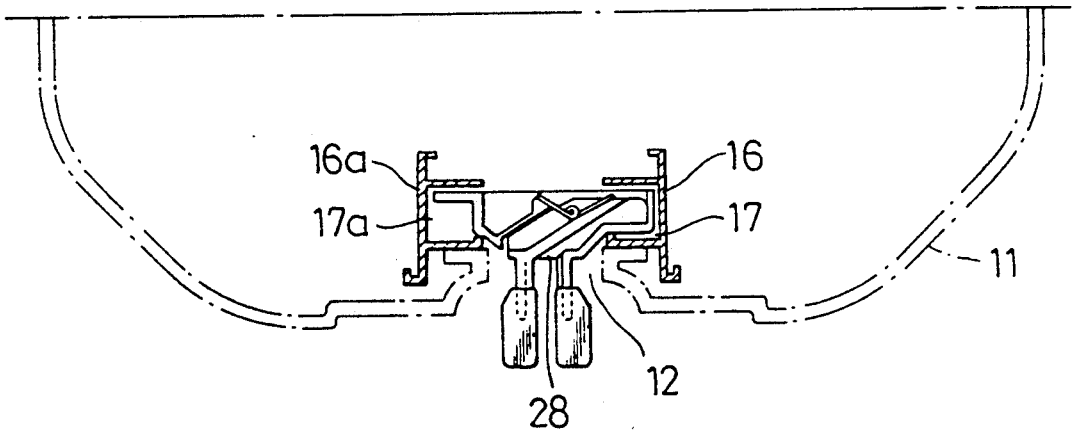
FIG. 14 is a sectional view of the device of FIG. 1 for showing relationship between the guide rail and a height control clamp.
Figure 15:
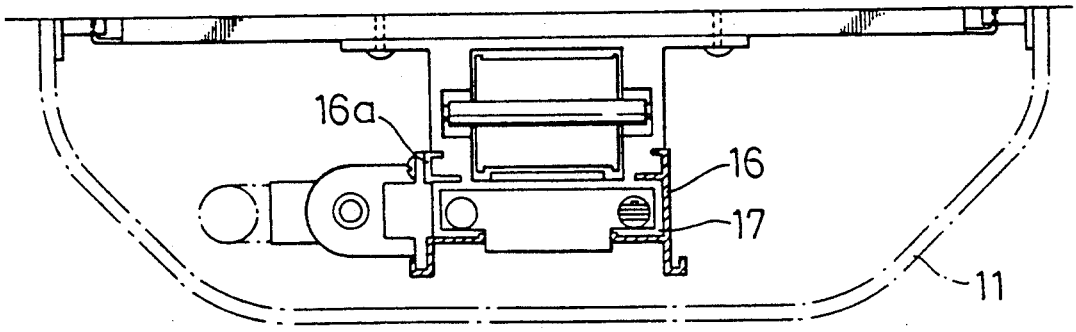
FIG. 15 is a sectional view of the device of FIG. 1 for showing relationship between the guide rail and the guide rail fixing base.

When the slider 14 slides along the slide rod 24 upward and engages the upper height control clamp 27, the slider 14 sliding upward urges the slide rod 24 to which the clamp 27 is secured and eventually the rack 30 secured to the rod 24 to be moved upward, so as to turn the change-over pinion 29 to be reversed. As the slider 14 slides downward and engages the lower height control clamp 28, the rack 30 is urged to move downward to turn the change-over pinion 29 in normal direction. With the upper and lower height control clamps 27 and 28 set as desired positions, therefore, it is made possible to attain the reciprocation of the slider 14 repeatedly in accordance with set interval between the both clamps 27 and 28, and to eventually realize the shower action in response to the reciprocating range, that is, as adapted to the height and the like of the user's body (see in FIG. 14).

Figure 7:
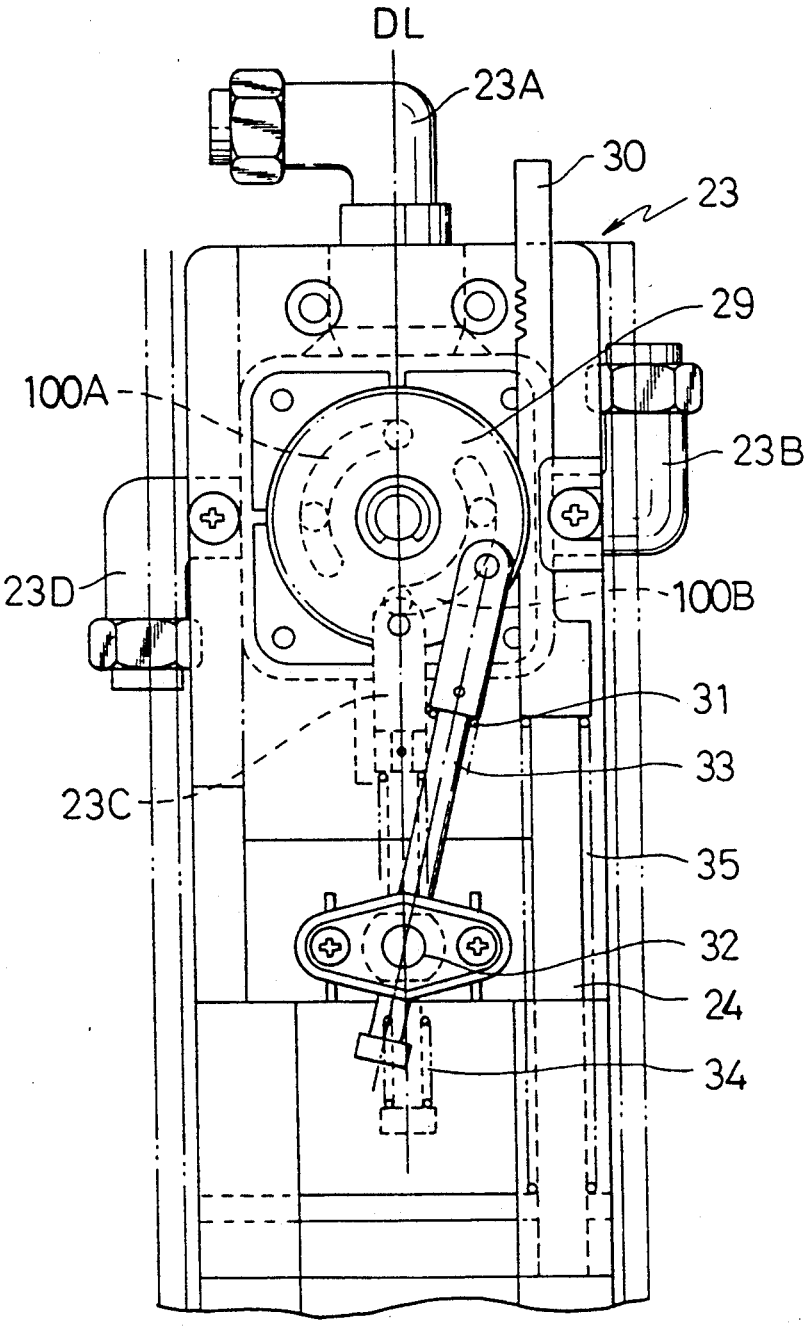
FIG. 7 is a fragmentary front view as magnified of the change-over valve of the slider drive system in the device of FIG. 1.

Further, a turning spring 31 is mounted to the change-over pinion 29. In the present instance, the spring 31 is mounted on a shaft 33 slidably held at one end portion by a pivoting shaft 32 while pivotably coupled at the other end to the pinion 29. As seen in particular in FIG. 7, the change-over pinion 29 rotated clockwise urges the shaft 33 carrying the spring 31 to shift from its tilted position of the spring and shaft 31 and 33 shown by solid lines toward a position shown by dotted lines on a dead-line DL connecting between the center of the pinion 29 and the center of the pivoting shaft 32, with the shaft 33 slid downward and the spring 31 thereon compressed and, as soon as the spring and shaft 31 and 33 are further urged to shift beyond the position on the dead-line DL, the shaft 33 starts to be slid upward to release the compressed spring 31, and this released spring force serves to accelerate always the change-over action of the valve 23. If required, a cushion spring 34 may be mounted on the one end portion of the shaft 33 extending from the pivoting shaft 32 on the other side carrying the spring 31, so as to act to absorb any shock imparted to the change-over pinion 29 upon its turning over and to restrain any excessive rotation of the pinion 29. In the event where the rack 30 moves downward with the slide rod 24, for example, the total weight of the rack 30, slide rod 24 and height control clamps 27 and 28 is to be imparted to the pinion 29, and this total weight is apt to impair the rapidness of the pinion's reverse turning with the upward movement of the rack 30, rod 23 and clamps 27 and 28. According to the present invention, however, such a braking spring 35 as a compression spring is mounted on the slide rod 24 at a portion immediately below the rack 30 so that the rod 24 and rack 30 will be always biased upward and a biasing force of this braking spring 35 is optimumly set to assure the reverse turning action of the change-over valve 23 against such total weight imparted to the pinion 29 as in the above. It should be also appreciated that the foregoing provision in particular of the cushion and braking springs 34 and 35 is effective to have the normal and reverse turning actions of the change-over valve 23 carried out both in equal manner to each other so as not to cause any hysteresis, and thus to eliminate any backlash noise or shock upon the turning-over action.

Figure 4:
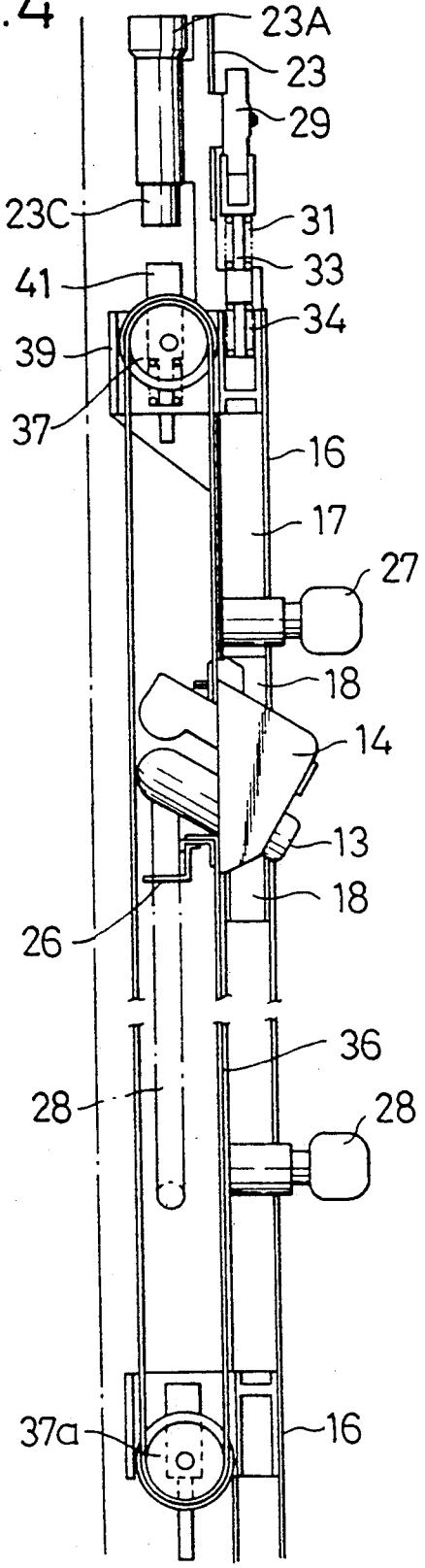
FIG. 4 is a fragmentary side elevation as magnified of the interior mechanism of the shower device in FIG. 2, with a part omitted.
Figure 5:
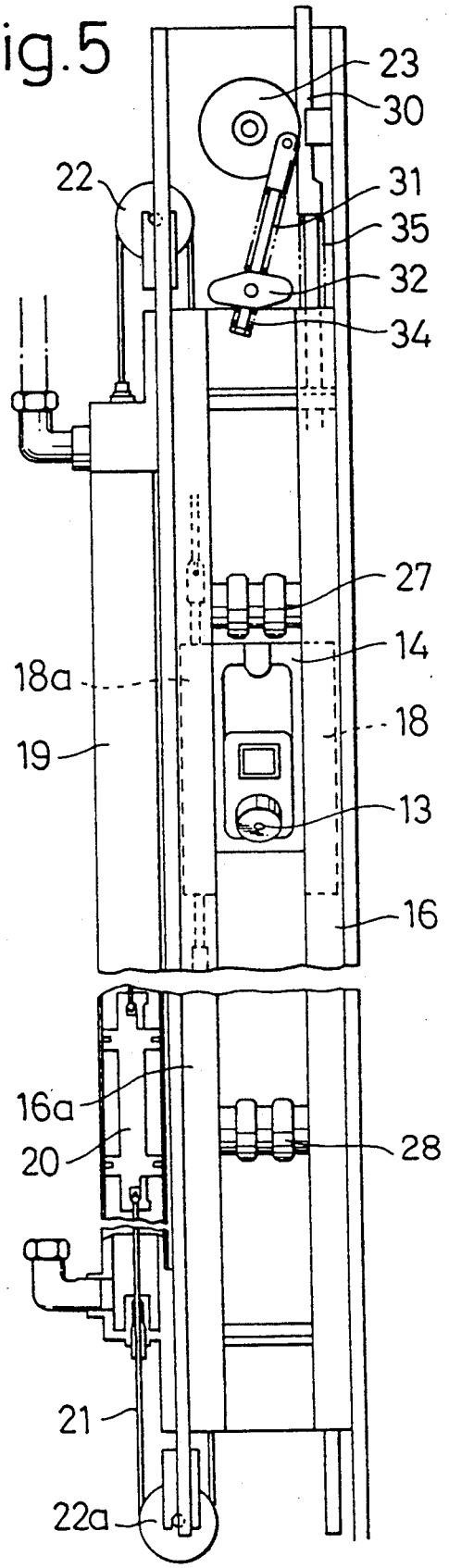
FIG. 5 is a fragmentary front elevation as magnified of the interior mechanism of FIG. 2 with a part omitted.
Figure 6:
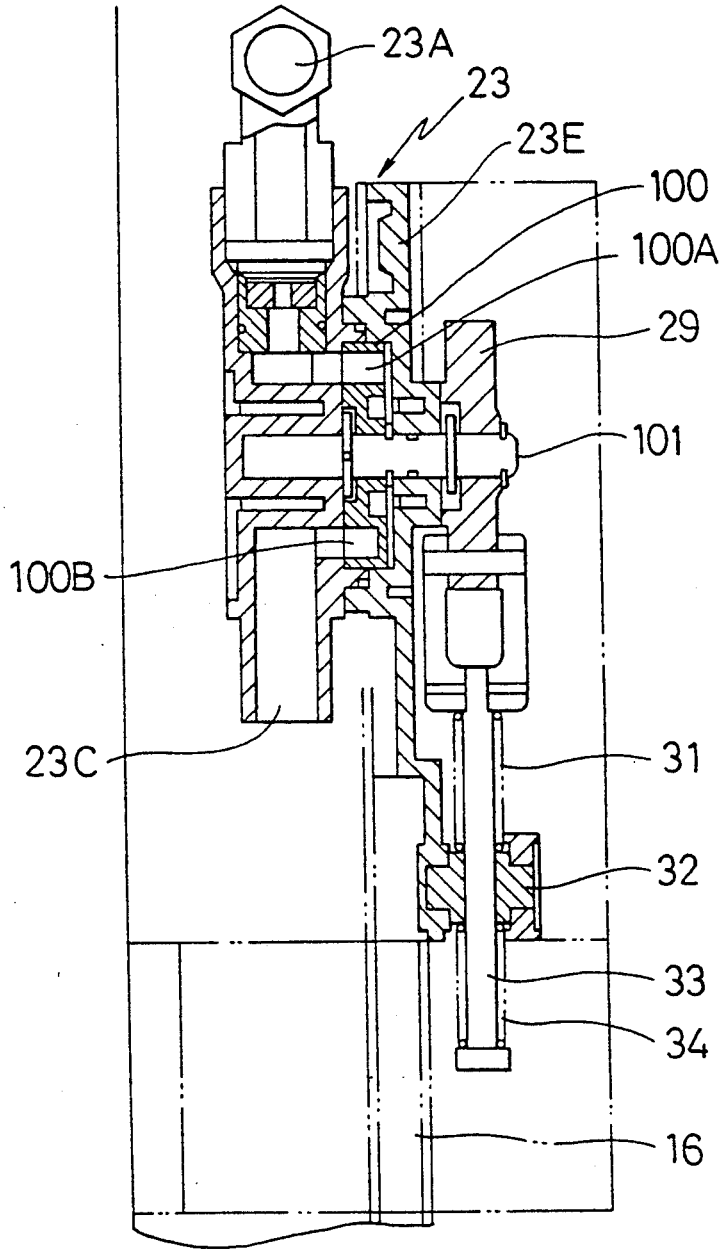
FIG. 6 is a fragmentary sectioned view as magnified of the change-over valve of the slider drive system in the shower device of FIG. 1.

To upper and lower side parts of the slider 14, both ends of a screening belt 36 are coupled while the belt 36 made into a loop through the slider 14 is hung between a pair of pulleys 37 and 37*a* vertically spaced, so as to be positioned immediately behind the slider 14 and guide rails 16 and 16*a* (FIG. 4). In other words, the slider 14 is positioned always on front side of the belt 36 during the upward and downward reciprocation, as exposed to the exterior through the slit, and the screening belt 36 closes the slit 12 above and below the slider 14. With this screening belt 36, water ejected from the shower nozzle 13 and splashed back from the user's body can be prevented from entering through the slit 12 into the device. In coupling this screening belt 36 with the slider 14, it is preferable for the dimensional minimization to dispose the space defined by the U-shaped flexible hoses 25 and 25*a* to be accommodated within the loop of the belt 36.

Figure 8:
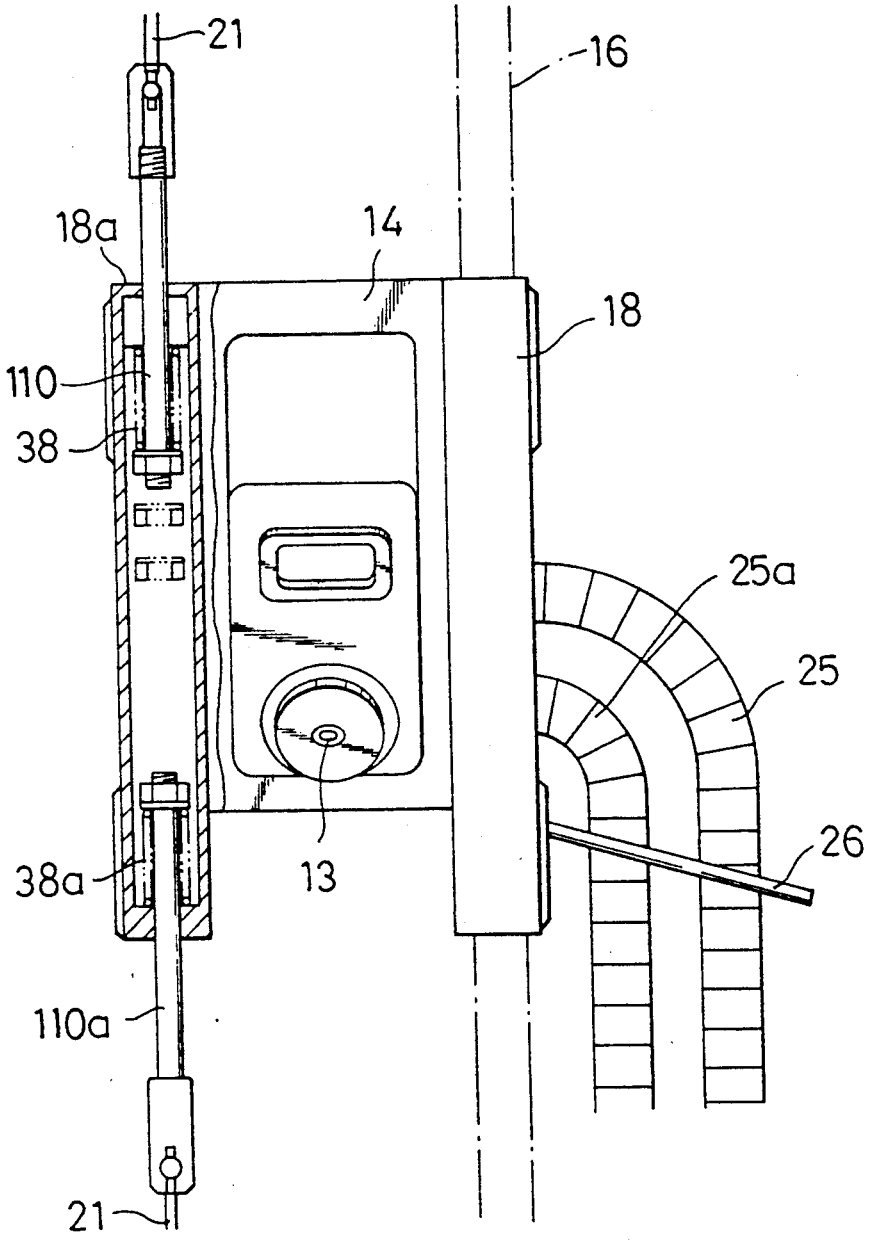
FIG. 8 is a fragmentary front view as magnified mainly of a slider shown with a part in section, in the device of FIG. 1.
Figure 9:
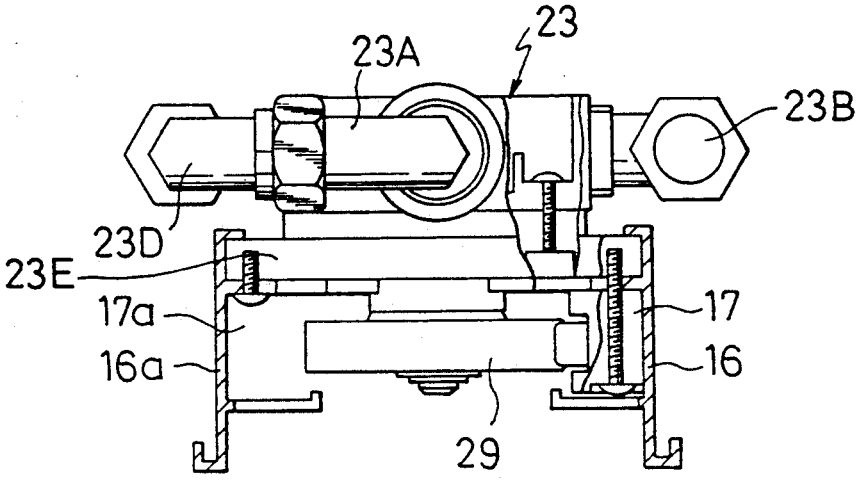
FIG. 9 is a fragmentary plan view as magnified mainly of the change-over valve in the device of FIG. 1.

In coupling the slider 14 to the wire 21, according to an optimum working aspect of the present invention, springs 38 and 38*a* may be mounted onto end-couplers 110 and 110*a* for the wire 21 so as to provide thereto a tension force (see FIG. 8). In an optimum working aspect of the present invention, further, the foregoing change-over valve 23 may be provided with a valve cover 23E to be supported by the guide rails 16 and 16*a* (FIG. 9).

Figure 10:
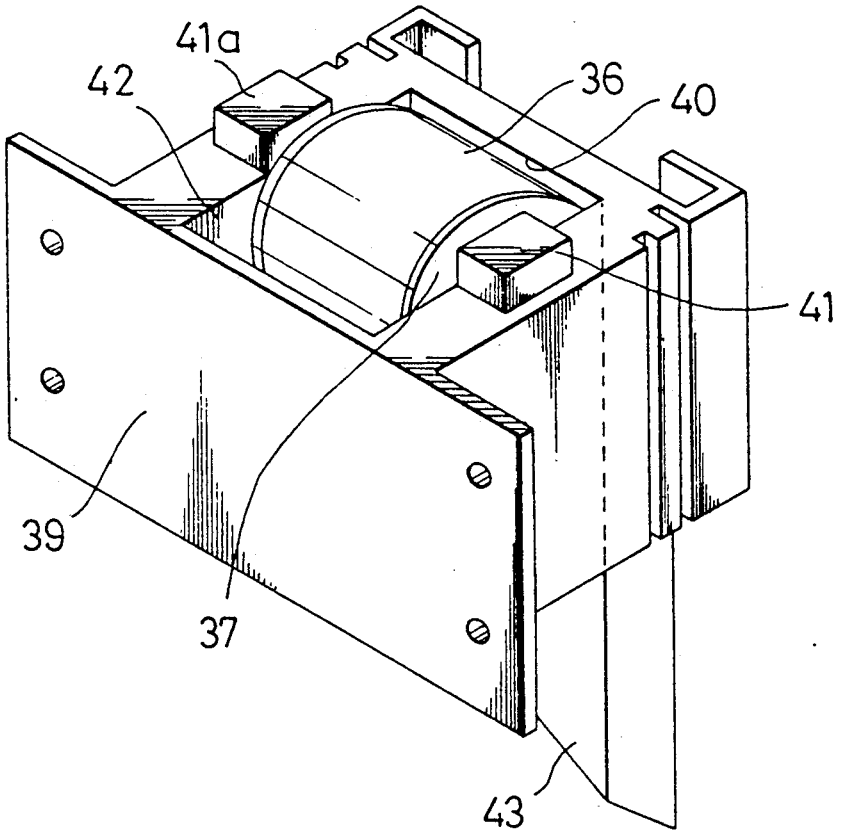
FIG. 10 is a fragmentary perspective view as magnified mainly of a fixing base for a guide rail in the shower device of FIG. 1.
Figure 11:
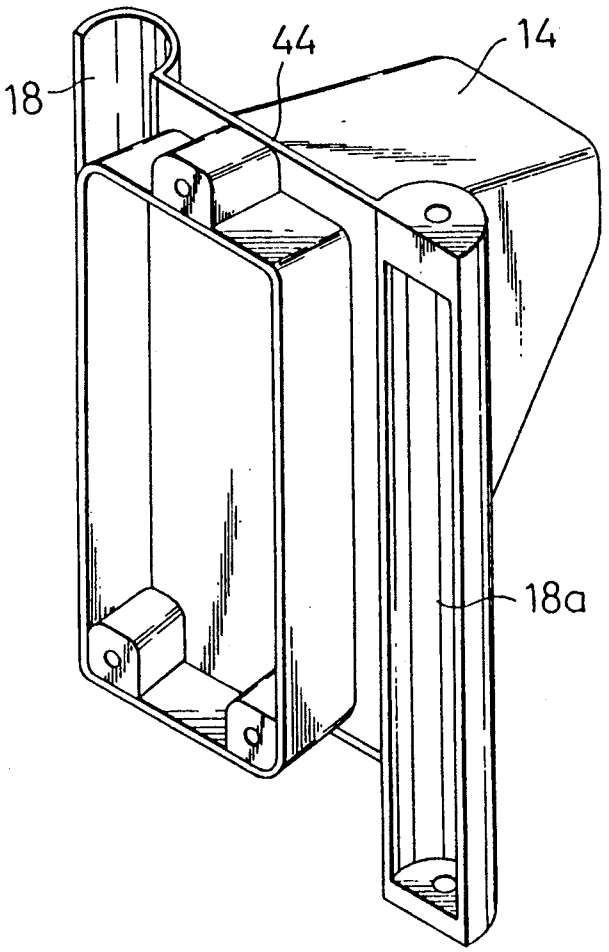
FIG. 11 is a perspective view as seen from rear side of the slider in the device of FIG. 1.

According to one feature of the present invention, further, the device is provided with a self-cleaning function for the screening belt 36. In the present instance, as will be seen in particular in FIG. 4, the water discharge port 23C is disposed to be right above the upper side pulley 37 for hanging the belt 36. In practice, the upper pulley 37 is disposed in a square mounting space 40 defined in an upper guide-rail fixing base 39 to be rotatably held by the base 39 through bearing members 41 and 41*a* so that a sort of small water reservoir 42 will be defined by three wall surfaces of the mounting space 40 and the screen belt 36 on the pulley 37 (FIG. 10), whereby the water discharged out of the discharge port 23C of the change-over valve 23 and reserved once in the small reservoir 42 will flow down from the reservoir 42 as the screening belt 36 rotates, in a state of water curtain over the length of the belt 36, and to thus clean the belt 36. In this case, a guiding strip 43 is provided to extend from a lower portion of the upper guide-rail fixing base 39, whereby the cleaning water can be made to flow along the belt while being prevented from scattering to front side of the belt 36, and it is eliminated that water droplets directly fall down to floor surface of the shower or bath room, so as not to have any trickling noise continued after the use of the shower, and so on. As shown in FIG. 11, further, it is also preferable to provide behind the slider 14 a partition 44 so that the cleaning water flowing down along the belt 36 can be prevented from scattering out of the slit 12 of the housing 11. With this partition 44, it is possible to lead the cleaning water to flow the both side sliding portions 18 and 18*a* of the slider and to the both guide rails 16 and 16*a*, so that the water can act as a lubricant for preventing slide contact parts from wearing during the reciprocation of the slider 14 along the guide rails 16 and 16*a*.

Figure 12:
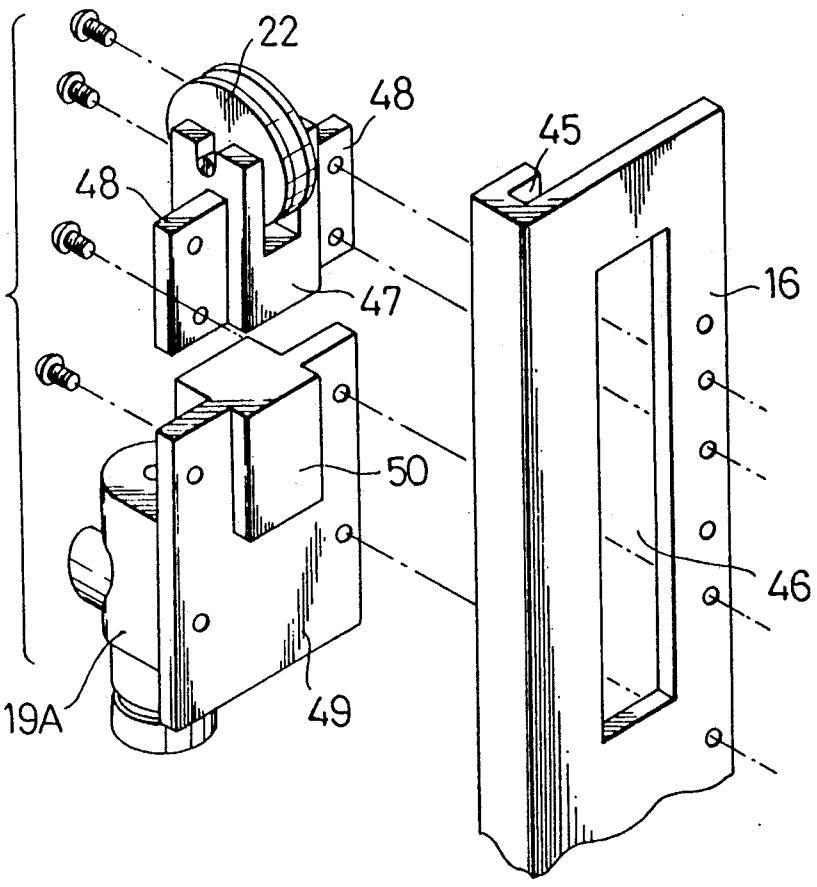
FIG. 12 is a fragmentary perspective view as magnified and disassembled of the slider drive system in the device of FIG. 1.

According to another feature of the present invention, the pulleys 22 and 22*a* for hanging between them the wire 21 are provided for position adjustment so as to obtain an excellent tension of the wire 21. Referring to FIG. 12, the guide rail 16 on one side is provided at least at its top portion with a guide groove 45 and a sliding aperture 46, a support base 47 for the upper part pulley 22 for the wire 21 is formed to have a main part vertically displaceable within the sliding aperture 46 and a sliding projection 48 laterally projected from the main part and slidably engaged in the guide groove 45 to be guided therealong. Preferably, a top end cap 19A of the hydraulic cylinder 19 is made integral with a fixing plate member 49 which is secured to the top portion of the guide rail 16, while this fixing member 49 is provided to be guided at its side end edge by the guide groove 45 of the rail 16 and at its bulging part 50 engageable in the sliding aperture 46. When this arrangement is adopted, the bulging part 50 and side edge of the fixing member 49 are first engaged in the sliding aperture 46 and guide groove 45, respectively, and then the member 49 is fixed to the guide rail 16 by fastening screws passed through an opposite side edge to the rail 16. The wire 21 connected to the piston 20 and made into a loop is hung between the pulleys 22 and 22*a*, the main part of the support base 47 supporting the pulley 22 is engaged in the slide aperture 46 and, in this state, such a tool as a screw driver or the like is inserted between the member 49 and the support base 47. With this tool operated for sufficiently separating the support base 47 from the fixing plate member 49, then the wire 21 can be hung between the pulleys 22 and 22*a* in a sufficiently tense state.

Figure 16:
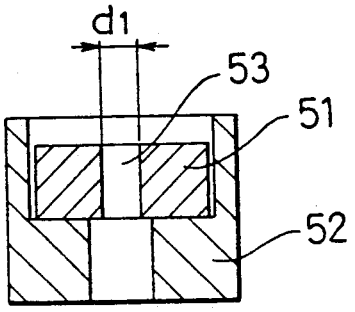
FIGS. 16 and 17 are explanatory views for an operation of a constant flow rate valve in the slider drive system of the device of FIG. 1.
Figure 17:
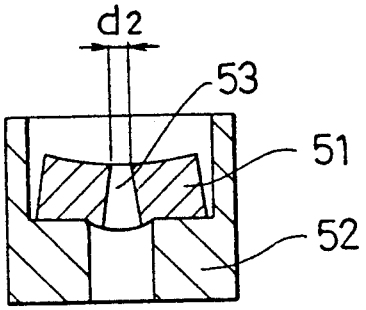
Figure 18:
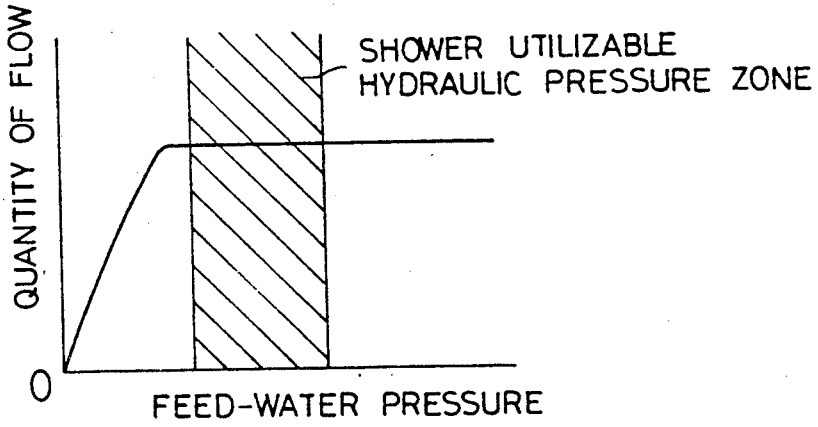
FIG. 18 is a characteristic diagram of the constant flow rate valve in the slider drive system of the device of FIG. 1.

According to still another feature of the present invention, further, the change-over valve 23 is provided with a constant flow rate function. That is, in the water supply port 23A of the change-over valve 23, a constant flow valve 52 as shown in FIG. 16 and having a pressure-deformable valve body 51 having a through hole 53 of a diameter d1 under no application of the water supply pressure is deformed by the water supply pressure raised and the supply rate increased to decrease the diameter to be d2, as shown in FIG. 17 so that, as shown in FIG. 18, the water supply rate is kept unchanged even when the supply pressure is varied, the amount of water supplied to the upper and lower spaces 20A and 20B in the hydraulic cylinder 19 is thereby made constant over the entire service range of the shower pressures, and the piston 20 and eventually the slider 14 can reciprocate at a constant speed.

Figure 19:
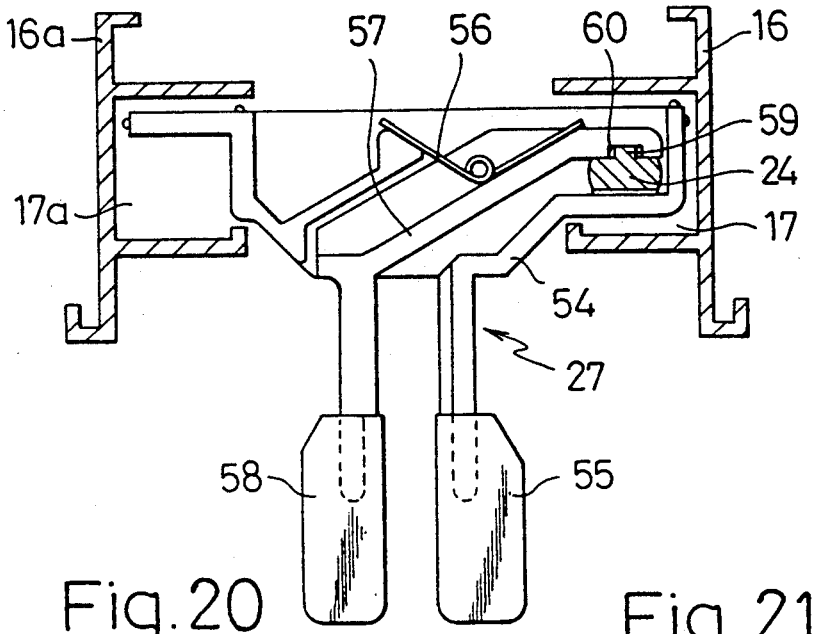
FIG. 19 is a fragmentary magnified view showing relationship between the guide rail and opening and closing levers for the height control clamp in the device of FIG. 1.
Figure 20:
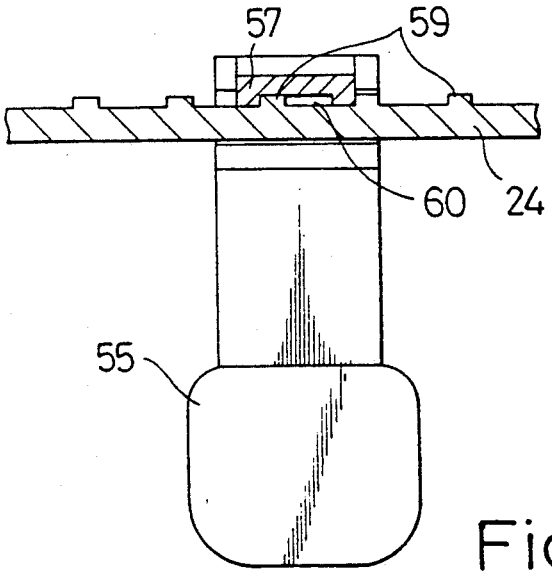
FIGS. 20 and 21 are diagrams showing relationship between the control clamp and a slide rod in the slider drive system of the device of FIG. 1.
Figure 21:
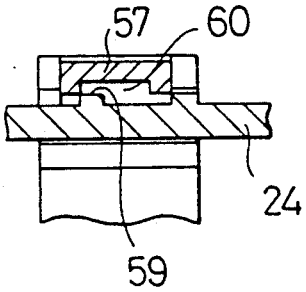

According to still another feature of the present invention, the upper and lower height control clamps 27 and 28 are provided for vertical position adjustment in a simpler and still reliable manner. Referring now to FIG. 19, the height control clamp 27 or 28 comprises a main clamp body 54 inserted across the both side guide grooves 17 and 17*a* of the guide rails 16 and 16*a*, and a stationary lever 55 is provided as extended from the body 54 to project on front side of the slit 12 of the housing 11. The upper height control clamp 27 is provided with a movable part 57 biased by a spring 56 to be normally urged to abut the main clamp body 54, and a movable lever 58 is extended from this movable part 57 to project on front side of the slit 12 in parallel relationship to the stationary lever 55. The slide rod 24 is disposed to be held between sideward end of the movable part 57 and opposing sideward end of the main clamp body 54. As will be clear when FIGS. 20 and 21 are referred to in conjunction, in a side elevation, the slide rod 24 is provided with a plurality of engaging stubs 59 projecting at positions mutually spaced in longitudinal direction of the rod 24, and the sideward end of the movable part 57 is formed to have engaging recesses 60 for receiving each of the stubs 59. Accordingly, the control clamp 27 can be displaced to any desired position by moving the movable lever 58 manually to be closer to the stationary lever 55 against the biasing force of the spring 56, upon which the sideward end of the movable part 57 being separated from the opposing sideward end of the main clamp body 54 with the stub 59 disengaged from the recess 60 to allow the clamp 27 to be slid along the guide rails 16 and 16*a* and the slide rod 24 as well, and the clamp 27 can be positioned and fixed again by engaging another stub 59 in the recess 60 in easy and reliable manner.

Figure 22:
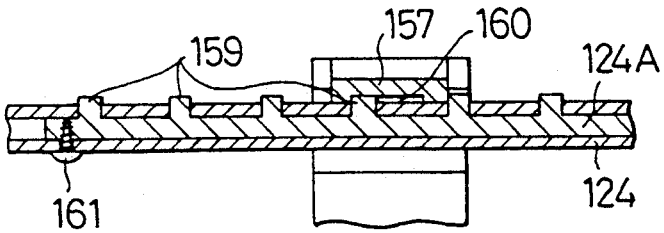
FIG. 22 shows in a fragmentary cross section a relationship between the control clamp and the slide rod in another working aspect of the slider drive system in the device of FIG. 1.
Figure 23:
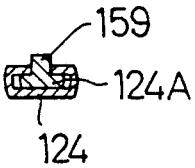
FIG. 23 is a cross section of the slide rod in the slider drive system of FIG. 22.

While in the above the upper height control clamp 27 has been disclosed, the lower height control clamp 28 can be formed in the same structure to perform the same function. For the engaging and disengaging arrangement of the slide rod and height control clamp, further, it may be also possible, as shown in FIGS. 22 and 23, to form a slide rod 124 substantially of a C-shaped section, into which an insert 124A having engaging stubs 159 is inserted and fixed by such as a screw 161 to have the stubs 159 projected out of the rod 124 for the engagement in the recess 160 of a movable part 157.

Figure 25:
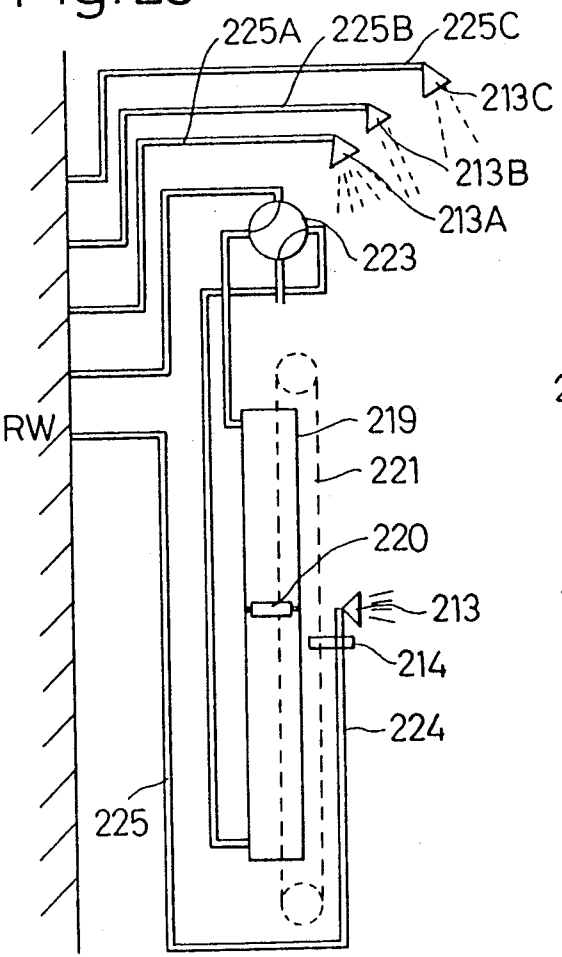
FIG. 25 is a schematic view for explaining the embodiment of FIG. 24.
Figure 24:
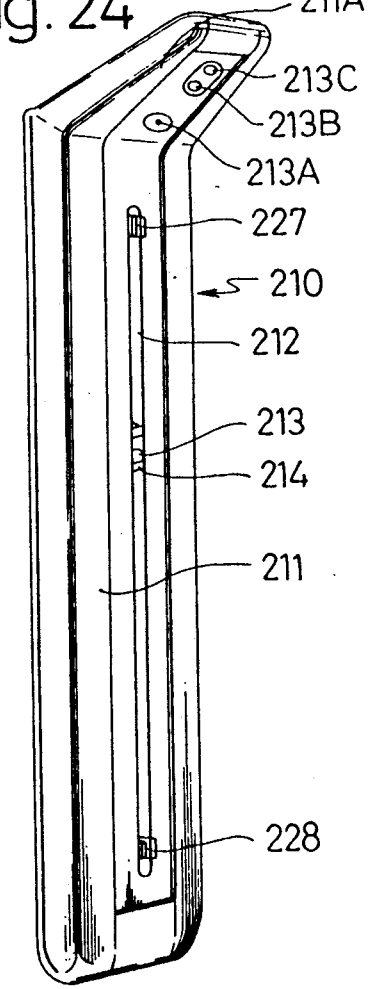
FIG. 24 is an entire perspective view in another embodiment of the shower device according to the present invention, in which a plurality of shower nozzles are provided.

According to still another feature of the present invention, further, a shower device 210 having a plurality of stationary nozzles in addition to the shower nozzle mounted to the vertically displaceable slider may be provided. Referring here to FIGS. 24 and 25, a housing 211 of the device 210 is formed to have substantially in its central part a longitudinally elongated slit 212, and substantially all of the constituents of the device including a reciprocating drive means for a slider 214 with a shower nozzle 213 secured thereto and a water supply means therefor are accommodated in the housing 211 substantially in the same manner as in the foregoing embodiment. In the present instance, the reciprocating drive means and water supply means are of the same arrangements as in the foregoing embodiment and capable of achieving the same functions, and the same constituents as those in the foregoing embodiment are denoted in FIGS. 24 and 25 by the same reference numerals but as added by 200. In the housing 211 of the present embodiment, on the other hand, there is provided an overhang 211A at top part of the housing to be above the slit 212 in which the slider 214 reciprocates, and a plurality (three in the present instance) of stationary nozzles 213A–213C are disposed in the overhang 211A. These stationary nozzles 213A–213C are disposed on the same vertical plane passing through the center line of the slit 212 on which the shower nozzle 213 is present and perpendicular to the wall surface of the shower or bath room, so as to keep the dimensional compactness of the entire device. Water supply hoses 225A–225C for these stationary nozzles 213A–213C are also accommodated within the overhang 211A of the housing 211 so as to keep the appearance excellent, as will be readily appreciated.

For the shower ejecting pattern of the stationary nozzles 213A–213C and of the reciprocating shower nozzle 213 of the slider 214 as well, there may be employable various patterns considered physiologically contributive to the activation of the human body.

Figure 26:
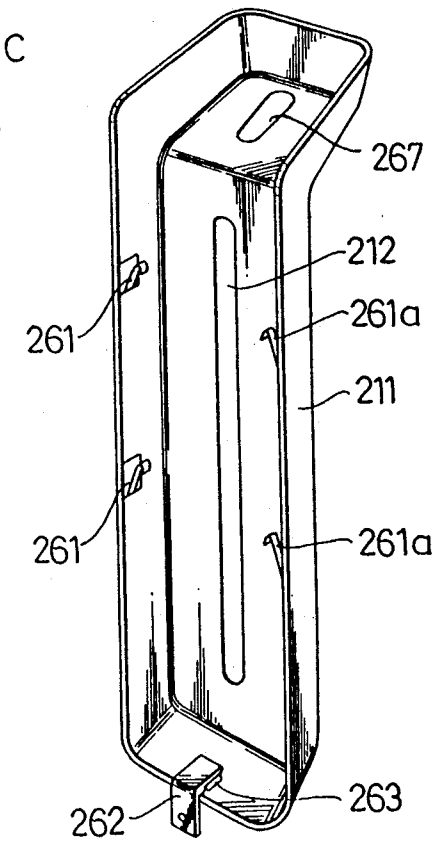
FIG. 26 is a perspective view as seen from reverse side of a front panel of a housing in the device of FIG. 24.

For the housing 211, on the other hand, the same is formed in a shape fully opened on reverse side as shown in FIG. 26 so that, when the housing 211 is installed against a wall surface RW of the shower or bath room, the substantially all constituents of the device 210 may be accommodated therein and, when the housing 211 is dismounted, required inspection and maintenance of substantially all of the constituents may be carried out. Further, hook members 261 and 261*a* are provided in pairs at inside edge parts of the housing 211 to project inward, and a fixing plate 262 L-shaped in section is mounted in the center of inside bottom edge part. This fixing plate 262 is extended at its lower portion to project downward, while the lower portion may be provided separate from upper portion as pivotably coupled thereto through a hinge, and, if required, a cushion member 263 may be interposed between the upper portion of the plate 262 and the inside bottom edge part of the housing to which part the plate is secured.

Figure 27:
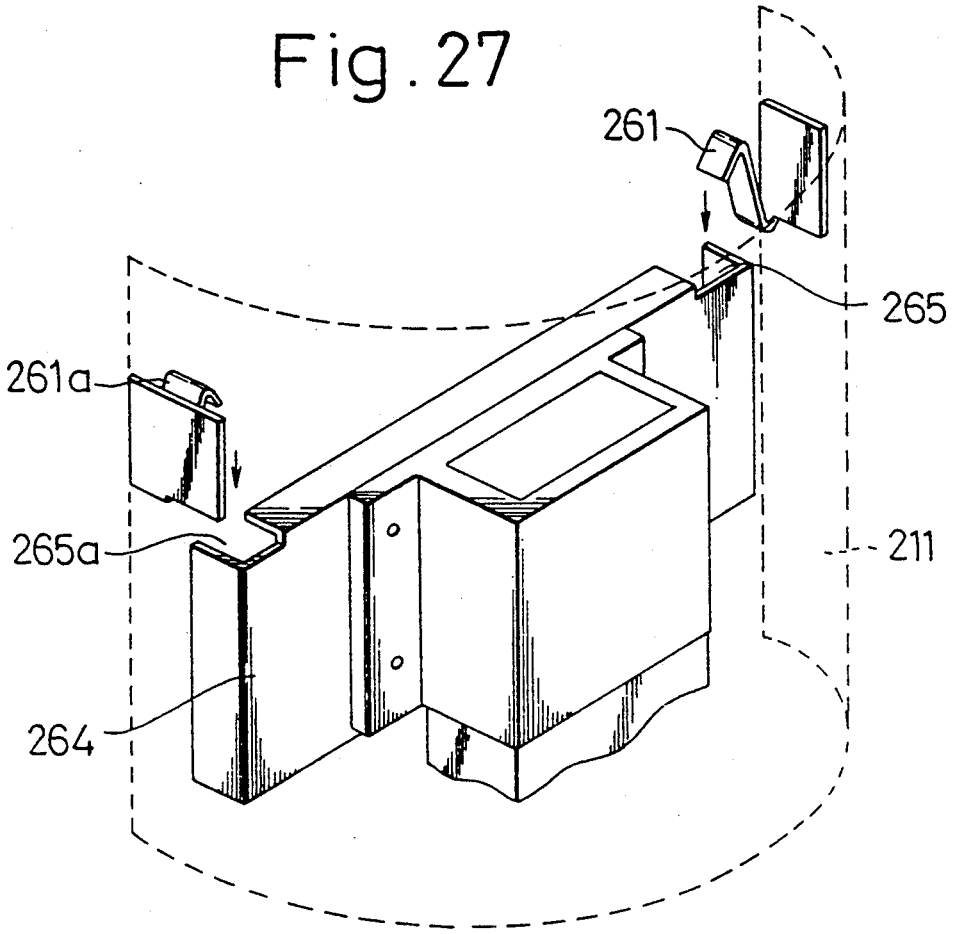
FIGS. 27 and 28 are explanatory views for the relationship between stationary hooks and hook receivers in the device of FIG. 24.
Figure 28:
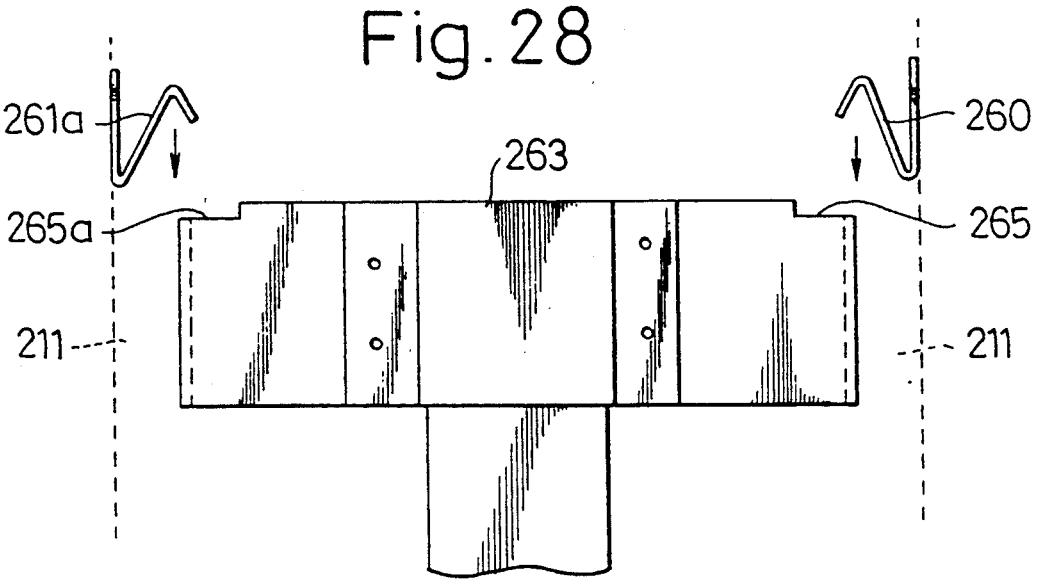
Figure 29:
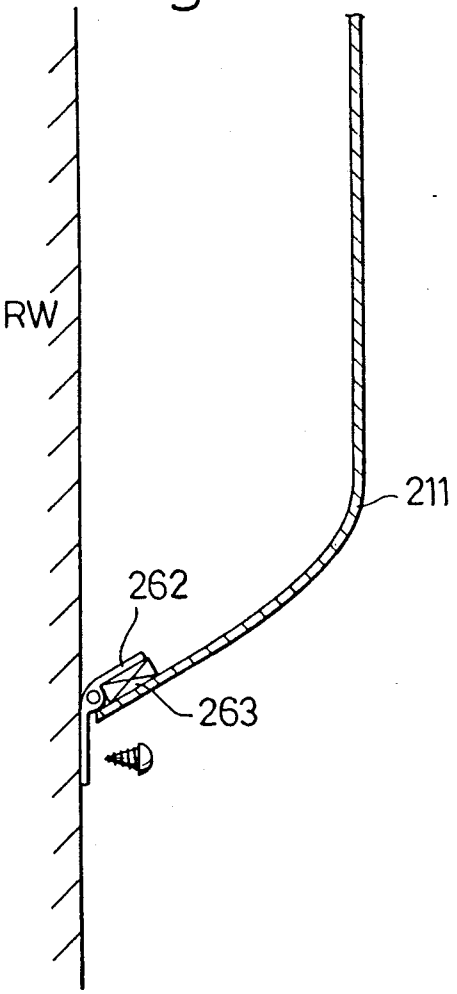
FIG. 29 is a fragmentary sectioned view at a lower part of the front panel of the housing in FIG. 26.

In the present instance, there are provided on the wall surface RW of the shower room as secured thereagainst, for example, two of support brackets 264 of such shape not hindering the disposition and function of the reciprocating drive means for the slider 214 and water supply means for the respective nozzles as shown in FIGS. 27 and 28, the support brackets 264 being provided at both side end parts with engaging notches 265 and 265*a* into which the hook members 261 and 261*a* of the housing 211 can be engaged. With this arrangement, the housing 211 can be easily installed on the wall surface RW by engaging the two pairs, for example, of the hook members 261 and 261*a* of the housing 211 into the engaging notched 265 and 265*a* of the support brackets 264 secured to the wall surface RW, substantially with all of the constituents of the device 210 accommodated within the housing 211. After such installation as in the above of the housing 211 onto the wall surface RW, the lower portion of the fixing plate 262 is fixed to the wall surface by means of a screw of the like, so as to prevent the housing 211 from being accidentally dismounted from the wall surface RW (see FIG. 29). In this case, the lower portion of the fixing plate 262 secured to the housing's bottom edge part at the upper portion of the plate 262 may be freely rotated because of the hinge connection between the upper and lower portion so that, immediately before the installation of the housing 211 onto the wall surface RW, the lower portion may be kept rotated to allow the bottom edge part of the housing 211 to be placed directly on floor surface of the shower room and the housing 211 to be leaned stably against the wall surface.

Figure 30:
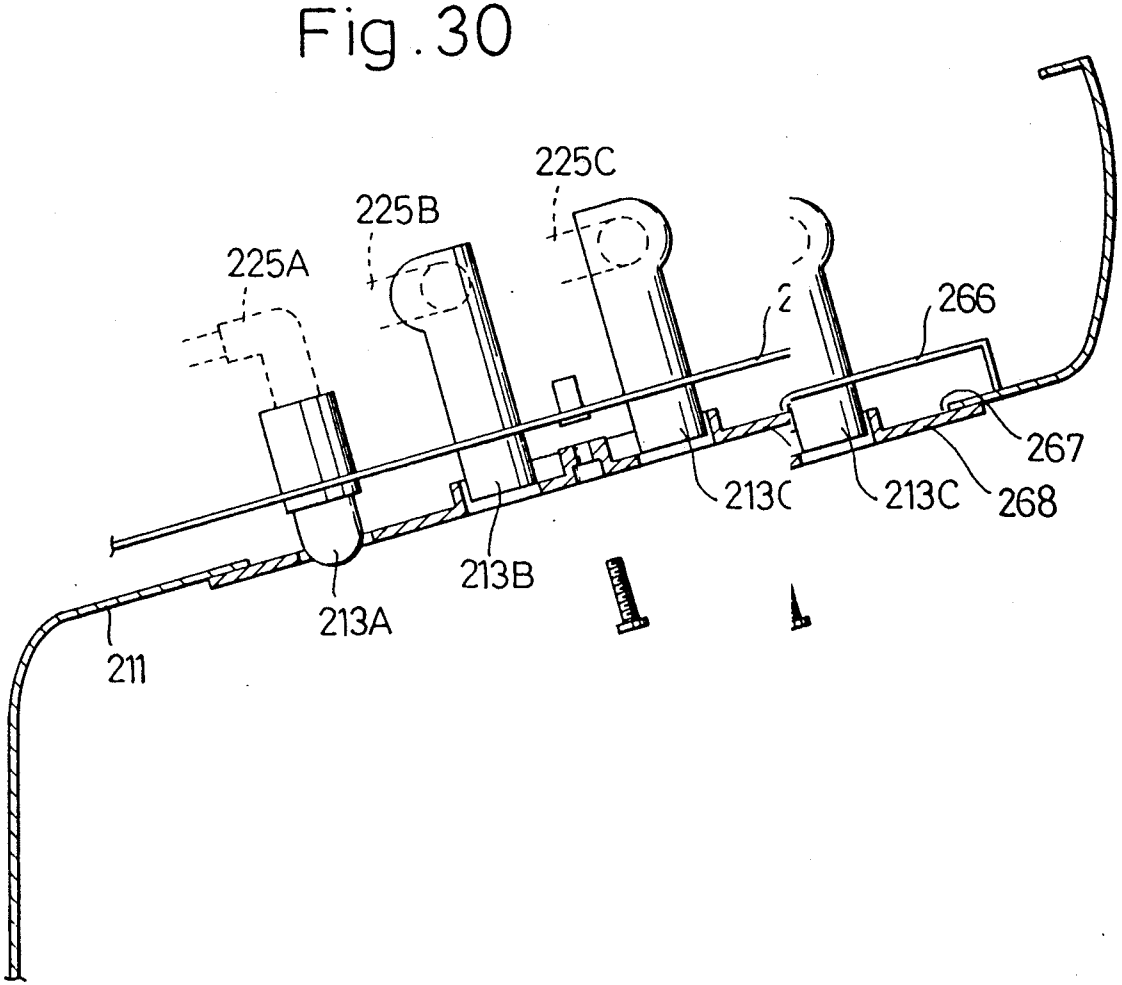
FIG. 30 is a fragmentary sectioned view at an upper part of the front panel of the housing as well as mounting positional relationship between upper shower nozzles and their holding plate.

In the overhang 211A of the housing 211, on the other hand, as shown in FIG. 30, a flexible holding frame 266 fixed preferably on one end side to a support frame (not shown in FIG. 30) for the change-over valve or the like and coupled to the stationary nozzles 213A–213C is disposed to be slightly spaced from bottom side of the overhang 211A, and the other free end of the holding frame 266 terminates to abut inner surface of the overhang 211A. In the bottom side of the overhang 211A, an aperture 267 is made to allow the stationary nozzles 213A–213C disposed as oriented downward, and a lid 268 is fitted to this aperture 267, the lid 268 being formed in a dimension enough for covering the aperture 267 except the downward ends of the nozzles 213A–213C and secured to the bottom side by means of a screw or the like fastened from the exterior to the holding frame 266. In installing the housing 211 onto the wall surface RW, therefore, in the event where the constituents of the device 210 are preliminarily installed thereonto, the housing 211 may be fitted over the thus installed device constituents with the tip positioned flexible holding frame 266 carrying the stationary nozzles 213A–213C kept as slightly bowed to be accommodated in the overhang 211A and to dispose the nozzles in the aperture 267, the lid 268 is secured to the position of covering the aperture, and top part of the housing 211 can be readily made securable.

What is claimed is:

1. A shower device comprising a housing having a slit longitudinally elongated substantially in a central part of said housing, a guide rail provided inside said housing to be disposed along said elongated slit, a slider means supporting a shower nozzle and displaceable for reciprocation along said guide rail, first water passage means for supplying water to said shower nozzle, and a driving means for hydraulically reciprocating said slider means for travel along said guide rail to apply said water ejected from said shower nozzle to and along a user's body, wherein said driving means comprises a drive element operably connected to said slider means so that displacement of said drive element produces travel of said slider means, a change-over valve connected to a source of pressurized water a pair of conduits each communicating with said drive element and said change-over valve for conducting water to and from said drive element for displacing said drive element, said change-over valve supplying pressurized water alternately to said conduits so that each of said conduits alternately defines a supply conduit conducting pressurized water to said drive element and a discharge conduit conducting discharge water away from said drive element, whereby the direction of displacement of said drive element is periodically reversed, said drive means arranged to keep said discharge water isolated from water in said first water passage means so that the pressure of water ejected from said shower nozzle is independent of water and pressure in said discharge conduit.

2. A device according to claim 1 wherein said first water passage mans for supplying water to said shower nozzle includes a flexible hose coupled at one end to said shower nozzle on said slider means and at the other end to a water supply pipe, said one end of said flexible hose being disposed on one side of said driving means while said other end of the flexible hose being disposed on the other side of the driving means, the flexible hose being thus suspended between its ends to be substantially in a U-shape adjacent a lower part of the driving means.

3. A device according to claim 1 which further comprises a screen belt displaceable in cooperation with said slider means driven by said driving means, said belt covering said slit of said housing for preventing said ejected water from entering into the housing through the slit.

4. A device according to claim 1 wherein said driving means further comprises a water supply and discharge system separated from said service water supplying means for said shower nozzle.

5. A device according to claim 1 wherein said change-over valve includes means for passing a constant amount of water.

6. A device according to claim 1 wherein said reciprocally driving means further comprises a hydraulic cylinder having therein said driving element in the form of a piston dividing the interior of said cylinder into upper and lower spaced, said piston being reciprocally shiftable in response to the supply and discharge of water to said upper and lower spaces by said conduits, and said slider means being coupled to said piston.

7. A device according to claim 1 wherein said change-over valve includes a first biasing means for accelerating change-over turning action of the valve and a second biasing means for restraining any excessive action of said first biasing means in light load direction.

8. A device according to claim 1 wherein said change-over valve has a discharge port for the water, the device further comprises a screenbelt provided displaceable in cooperation with said slider means to cover said slit of said housing for preventing any water entering through the slit from the exterior into said housing, discharge water from said discharge port of said change-over valve being supplied onto said screen belt.

9. A device according to claim 1 which further comprises a pair of height control means mounted to said guide rail for positioning at any desired position thereon, and said change-over valve is arranged to change the reciprocating direction of said slider means every time when the slider means reaches one of said pair of height control means.

10. A device according to claim 1 wherein said guide rail, said slider means, said means for supplying water to said shower nozzle, and said reciprocally driving means are accommodated within said housing with an ejecting end only of said shower nozzle being disposed to the exterior of said housing.

11. A device according to claim 3 including means for directing water against said belt within said housing for cleaning and lubricating said belt.

12. A device according to claim 5 including a constant flow valve for establishing a constant water flow rate for said driving means.

13. A shower device according to claim 1 including a low pressure pump connected to said second water passage means for supplying water to said change-over valve.

* * * * *